US005534746A

United States Patent [19]

Marks et al.

[11] Patent Number: 5,534,746

[45] Date of Patent: Jul. 9, 1996

[54] COLOR PICTURE TUBE HAVING SHADOW MASK WITH IMPROVED APERTURE SPACING

[75] Inventors: Bruce G. Marks; Theodore F. Simpson, both of Lancaster, Pa.

[73] Assignee: Thomson Consumer Electronics, Inc., Indianapolis, Ind.

[21] Appl. No.: 467,119

[22] Filed: Jun. 6, 1995

[51] Int. Cl.[6] ..... H01J 29/07

[52] U.S. Cl. ..... 313/408; 313/402

[58] Field of Search ..... 313/402, 403, 313/408

[56] References Cited

U.S. PATENT DOCUMENTS

| | | | |
|---|---|---|---|
| 3,590,303 | 6/1971 | Coleclough | 313/408 |
| 3,705,322 | 12/1972 | Naruse et al. | 313/408 |
| 3,721,853 | 3/1973 | Naruse et al. | 313/402 |
| 4,136,300 | 1/1979 | Morrell | 313/403 |
| 4,983,879 | 1/1991 | Kawaguchi | 313/408 X |
| 5,030,881 | 7/1991 | Marks et al. | 313/408 X |
| 5,055,736 | 10/1991 | Yun et al. | 313/402 |
| 5,086,250 | 2/1992 | Van Der Waal | 313/408 X |

FOREIGN PATENT DOCUMENTS 455324 2/1970 Japan .

*Primary Examiner*—Sandra L. O'Shea
*Assistant Examiner*—Ashok Patel
*Attorney, Agent, or Firm*—Joseph S. Tripoli; Dennis H. Irlbeck

[57] ABSTRACT

An improved color picture tube includes a shadow mask and a dot screen, wherein the mask is rectangular and has two horizontal long sides and two vertical short sides. The long sides parallel a central major axis of the mask and the short sides parallel a central minor axis of the mask. The mask includes an array of apertures arranged in vertical columns and horizontal rows. Apertures in one row are in different columns than are the apertures in adjacent rows. The vertical spacing between apertures in the same column is the vertical pitch of the apertures and the horizontal spacing between apertures in the same row is the horizontal pitch of the apertures. The improvement includes the horizontal pitch of the apertures increasing from the minor axis to the short sides of the mask and decreasing from the major axis to the long sides of the mask. Also, along the major axis, the vertical pitch of the mask decreases from the center to the short sides of the mask and, adjacent the long sides of the mask, it increases from the minor axis to the corners of the mask.

3 Claims, 4 Drawing Sheets

COLOR PICTURE TUBE HAVING SHADOW MASK WITH IMPROVED APERTURE SPACING

This invention relates, generally, to color picture tubes of a type having shadow masks for use with dot screens, wherein the shadow mask apertures are round nearly round, elliptical or nearly elliptical and are usually aligned in staggered rows and columns; and, particularly, to an improved spacing between the rows and columns of such apertures.

BACKGROUND OF THE INVENTION

Several factors may cause misregistry of an electron beam with a phosphor element on a color picture tube screen. One of these factors is the thermal expansion of a shadow mask of the tube, when the mask is heated by electron beams from an electron gun of the tube that strike the mask. The shadow mask is usually attached to a peripheral frame that surrounds the mask. During tube operation, heat from the mask flows into the frame, creating a differential in temperatures between the center and peripheral portions of the mask. Because of this differential, the mask center, mask periphery and frame expand at different rates. These different expansion rates result in an arching or doming of the shadow mask. Because of such doming, the electron beams passing through the mask misregister with the phosphor elements of the tube screen. One method of compensating for mask doming is taught in U.S. Pat. No. 4,136,300, issued to A. M. Morrell on Jan. 23, 1979. That patent discloses the desirability of increasing the curvature of a mask to reduce electron beam misregister caused by mask doming. The patent also teaches that, with the increased curvature, the horizontal center-to-center spacing between shadow mask apertures should be increased from the center of the mask to the ends of the horizontal axis.

In the design of dot screen type color picture tubes that can be used in video displays, it is desirable to utilize greater mask curvature along with variable aperture spacing, in order to gain the advantage of reduced misregister as well as the additional advantages of being able to use higher anode power, providing simpler manufacturability, increased mask strength and reduced microphonics. However, a problem exists, relating to how aperture spacing should be varied in order to obtain a screen with uniformly straight parallel rows of phosphor dots, to minimize moiré.

SUMMARY OF THE INVENTION

In accordance with the present invention, an improved color picture tube includes a shadow mask and a dot screen, wherein the mask is rectangular and has two horizontal long sides and two vertical short sides. The long sides parallel a central major axis of the mask, and the short sides parallel a central minor axis of the mask. The mask includes an array of apertures arranged in vertical columns and horizontal rows. Apertures in one row are in different columns than are the apertures in adjacent rows. The vertical spacing between apertures in the same column is the vertical pitch of the apertures, and the horizontal spacing between apertures in the same row is the horizontal pitch of the apertures. The improvement comprises the horizontal pitch of the apertures increasing from the minor axis to the short sides of the mask and decreasing from the major axis to the long sides of the mask. Also, along the major axis, the vertical pitch of the mask decreases from the center to the short sides of the mask and, adjacent the long sides of the mask, it increases from the minor axis to the corners of the mask.

DETAILED DESCRIPTION OF THE PREFERRED EMBODIMENTS

Figure 1:
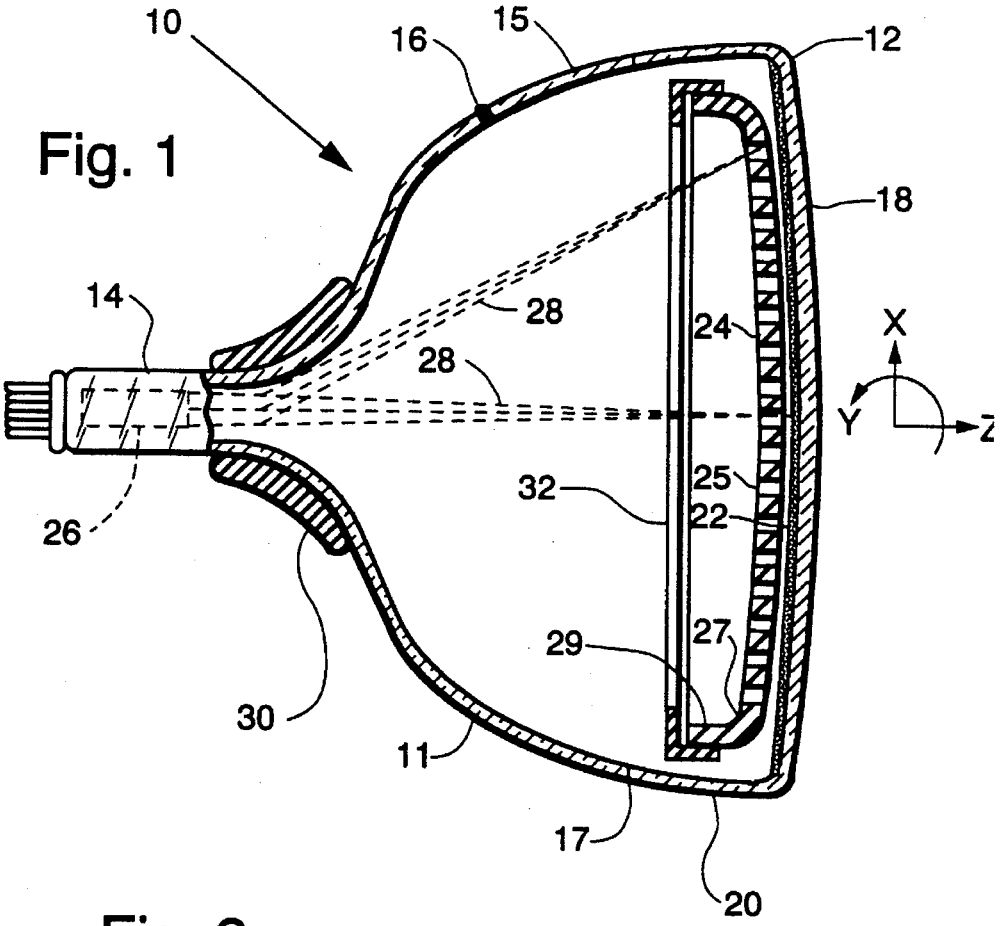
FIG. 1 is a partially sectioned axial side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a dot screen, with the phosphor dots arranged in triads, each triad including a phosphor dot of each of three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14, to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within (or, alternatively, over) the frame 34, and the skirt portion 29 is welded to the frame 34.

Figure 2:
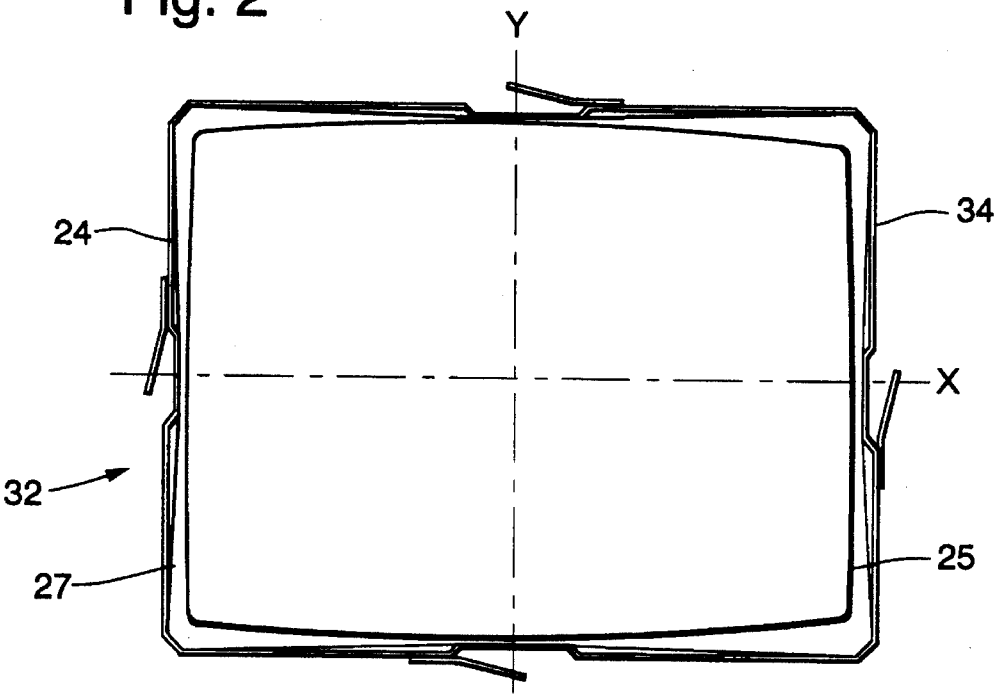
FIG. 2 is a front plan view of a shadow mask-frame assembly of the tube of FIG. 1.
Figure 3:
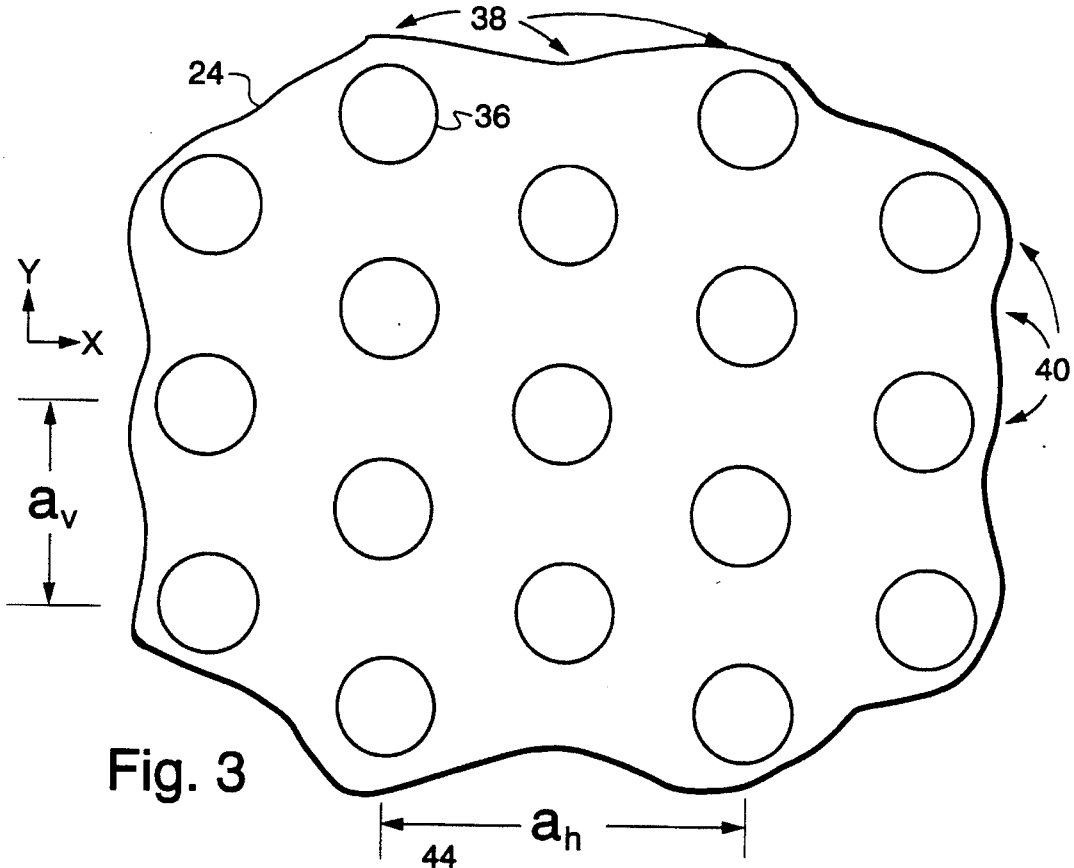
FIG. 3 is a small section of the shadow mask of the assembly of FIG. 2, used for illustrating aperture pitch.

The shadow mask 24, shown in plan view in FIG. 2, has a rectangular periphery with two long sides and two short sides. The mask 24 has a major axis X, which passes through the center of the mask and parallels the long sides, and a minor axis Y, which passes through the center of the mask and parallels the short sides. The mask 24 includes an array of round apertures 36, arranged in staggered vertical columns 38 and horizontal rows 40, as shown in detail in FIG. 3. The columns 38 approximately parallel the minor axis Y, and the rows 40 approximately parallel the major axis X. The apertures in one row are in different columns than the apertures in the adjacent rows. The vertical spacing between adjacent apertures in the same column is defined as the vertical pitch $a_v$ of the apertures, and the horizontal spacing between adjacent apertures in the same row is defined as the horizontal pitch ah of the apertures.

Figure 4:
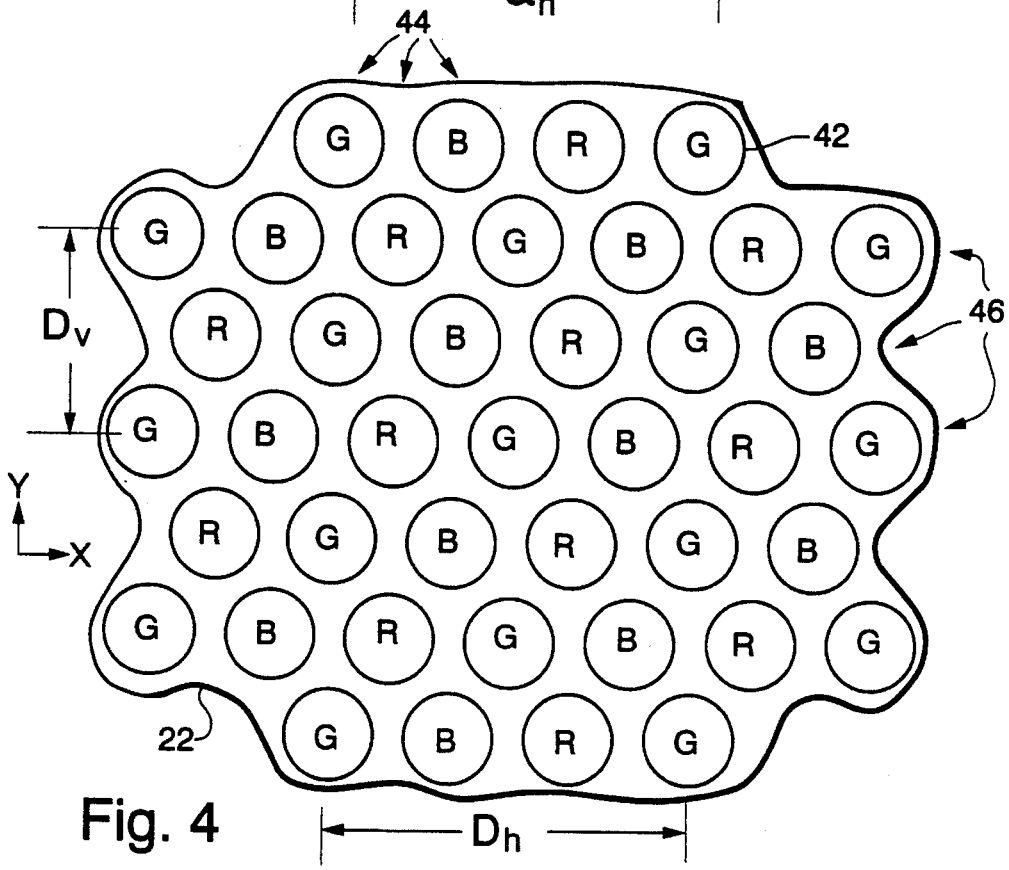
FIG. 4 is a small section of a dot screen of the tube of FIG. 1, illustrating dot pitch.

The screen 22 includes a pattern of phosphor dots 42 arranged in staggered vertical columns 44 and horizontal rows 46, as shown in FIG. 4. The columns 44 approximately parallel the minor axis Y, and the rows 46 approximately parallel the major axis X. The vertical spacing between adjacent dots in the same column is defined as the vertical pitch $D_v$ of the dots, and the horizontal spacing between dots in the same row that emit light of the same color is defined as the horizontal pitch $D_h$ of the dots.

The aperture pitch at any location on a mask can be determined by calculating either the vertical or horizontal spacing between two adjacent apertures at the location. This calculation can be performed by using the following equations (1) and (3) for the vertical position $Y_n$ of an aperture in row n and for the horizontal position $X_m$ of an aperture in column m, of the mask, respectively.

$$Y_n=Y_{0n}+A_1Y_{0n}x^2+A_2Y_{0n}^3x^2+A_3Y_{0n}^5x^2+A_4Y_{0n}x^4+A_5Y_{0n}^3x^4+A_6Y_{0n}^5x^4 \quad (1)$$

where x is the horizontal distance of the aperture from the minor axis, along row n;

where $A_1$, $A_2$, $A_3$, $A_4$, $A_5$ and $A_6$ are coefficients that are related to the relative curvatures of the faceplate panel and shadow mask; and where $Y_{0n}$ is the minor axis intercept of aperture row number n, which is determined by the equation, $$Y_{0n}=C_1n+C_2n^2+C_3n^3+C_4n^4, \quad (2)$$

where $C_1$, $C_2$, $C_3$ and $C_4$ are coefficients that are related to the relative curvatures of the faceplate panel and shadow mask and n is a row number for a particular aperture row.

$$X_m=X_{0m}+B_1X_{0m}y^2+B_2X_{0m}^3y^2+B_3X_{0m}^5y^2+B_4X_{0m}y^4+B_5X_{0m}^3y^4+B_6X_{0m}y^6 \quad (3)$$

where y is the vertical distance of the aperture from the major axis, along column m;

where $B_1$, $B_2$, $B_3$, $B_4$, $B_5$ and $B_6$ are coefficients that are related to the relative curvatures of the faceplate panel and shadow mask; and where $X_{0m}$ is the major axis intercept of aperture column m, which is determined by the equation, $$X_{0m}=D_1m+D_2m^2+D_3m^3+D_4m^4+D_5m^5 \quad (4)$$

where $D_1$, $D_2$, $D_3$, $D_4$ and $D_5$ are coefficients that are related to the relative curvatures of the faceplate panel and shadow mask and m is a column number for a particular aperture column.

The vertical pitch $a_{v(76\text{-}74)}$ between rows 74 and 76 is determined by solving the vertical position equation $Y_n$ twice, once for n=74 and once for n=76. Note that row 75 does not contain an aperture that is in the same column as are the apertures in rows 74 and 76. The vertical pitch $a_{v(76\text{-}74)}$ then is equal to $Y_{76}-Y_{74}$. Similarly, the horizontal pitch $a_{h(80\text{-}78)}$ between columns 78 and 80 is determined by solving the horizontal position equation $X_m$ twice, once for m=78 and once for m=80. The horizontal pitch $a_{h(80\text{-}78)}$ then is equal to $X_{80}-X_{78}$.

In one particular embodiment the coefficients for the above equations are as follows, with all dimensions in millimeters (mm). These coefficients were selected to assure that the vertical pitch $D_v$ of the screen dots remains constant over the entire screen.

Figure 5:
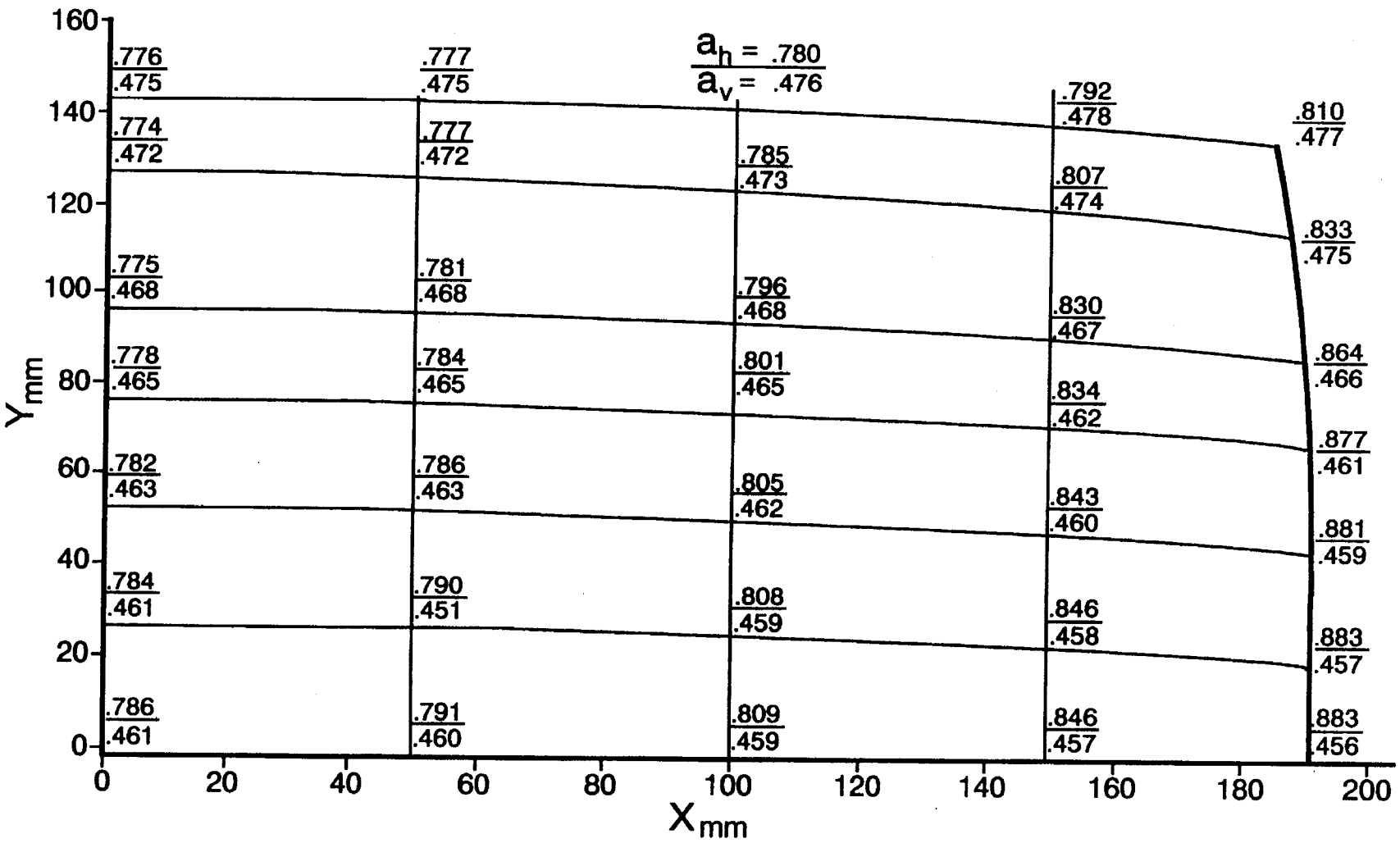
FIG. 5 is an upper right quadrant of the shadow mask of FIG. 2, showing the curvatures of various rows and columns of apertures in the mask and presenting horizontal and vertical pitches for a particular embodiment of the mask.
Figure 6:
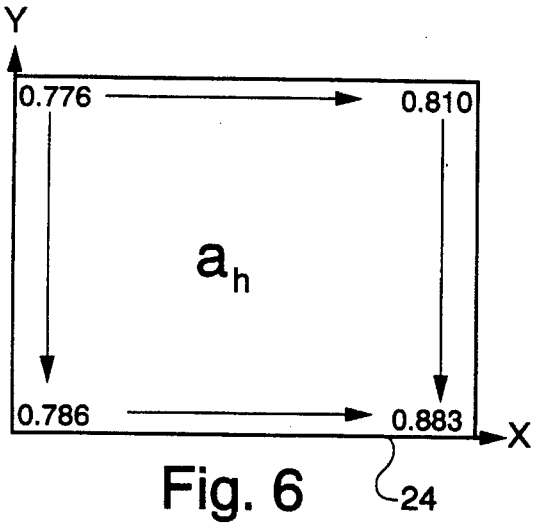
FIG. 6 is an upper right quadrant of the shadow mask embodiment of FIG. 5, showing the horizontal pitches between apertures within rows at four locations.
Figure 7:
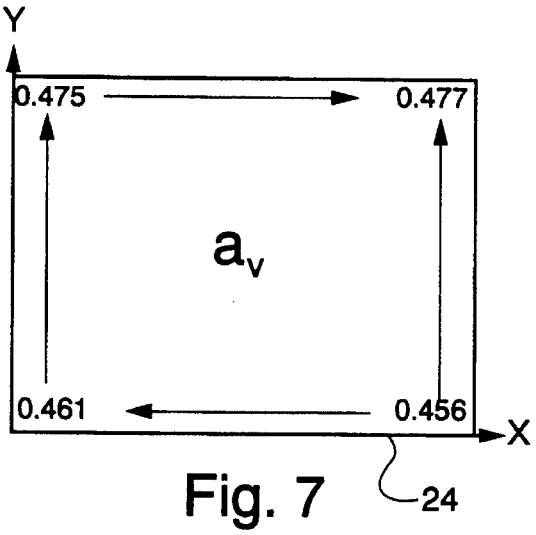
FIG. 7 is an upper right quadrant of the shadow mask embodiment of FIG. 5, showing the vertical pitches between apertures within columns at four locations.

$C_1=0.461\times10^{0}$ $C_2=-0.765\times10^{-6}$ $C_3=0.632\times10^{-7}$ $C_4=-0.294\times10^{-10}$ $A_1=-0.382\times10^{-6}$ $A_2=0.244\times10^{-11}$ $A_3=0.284\times10^{-15}$ $A_4=0.321\times10^{-11}$ $A_5=-0.174\times10^{-15}$ $A_6=0.545\times10^{-20}$ $D_1=7.844\times10^{-1}$ $D_2=7.818\times10^{-6}$ $D_3=3.858\times10^{-7}$ $D_4=9.233\times10^{-10}$ $D_5=-9.557\times10^{-13}$ $B_1=-1.703\times10^{-6}$ $B_2=2.394\times10^{-12}$ $B_3=2.412\times10^{-16}$ $B_4=5.072\times10^{-11}$ $B_5=-2.453\times10^{-15}$ $B_6=3.059\times10^{-16}$ FIG. 5 shows the horizontal and vertical pitches, $a_h$ and $a_v$, respectively, at selected locations on an upper right quadrant of a mask, that were calculated using the specific coefficients above in the preceding equations. The pitch variations between the center, sides and corner of the mask 24 of FIG. 5 are shown in FIGS. 6 and 7. FIG. 6 shows that the mask horizontal pitch $a_h$ increases from the minor axis Y to the short sides of the mask, and decreases from the major axis X to the long sides of the mask. FIG. 7 shows that the mask vertical pitch $a_v$ increases from the major axis X to the long sides of the mask; but, along the major axis X, it decreases from the center to the short sides of the mask and, adjacent the long sides, it increases from the minor axis Y to the corners of the mask. The increase in vertical pitch $a_v$ from the major axis X to the long sides of the mask usually occurs when the sides of the screen are outwardly bowed.

Figure 8:
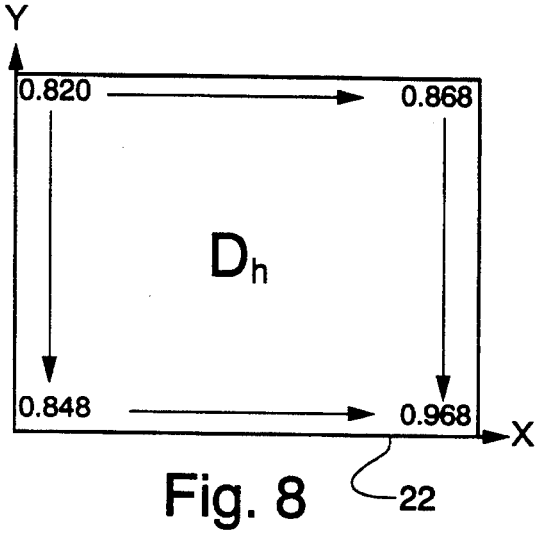
FIG. 8 is an upper right quadrant of the viewing screen of the tube of FIG. 1, associated with the shadow mask of FIG. 5, showing the horizontal center-to-center spacing between the centers of phosphor dot triads at four locations.
Figure 9:
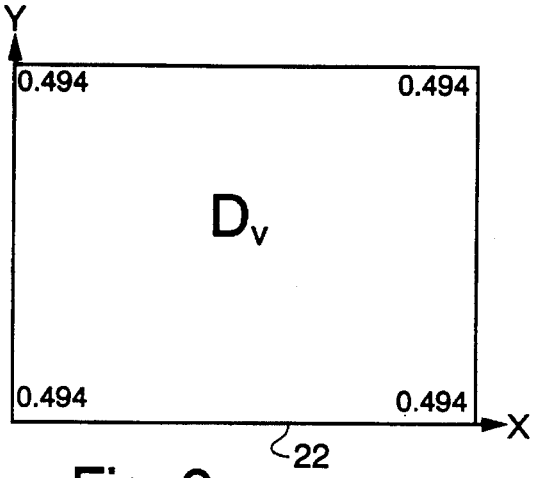
FIG. 9 is an upper right quadrant of the viewing screen of the tube of FIG. 1, associated with the shadow mask of FIG. 5, showing the vertical center-to-center spacing between the centers of phosphor dot triads at four locations.

By using the mask specified above, a screen may be obtained that has the horizontal and vertical pitches $D_h$ and $D_v$, shown in FIGS. 8 and 9, respectively. Although the screen horizontal pitch $D_h$ increases from the minor axis Y to the short sides of the screen and decreases from the major axis X to the long sides of the screen, there is no variation in the screen vertical pitch $D_v$ over the entire screen. Because the vertical pitch of the screen is constant over the screen, moiré is minimized.

What is claimed is:

1. In a color picture tube having a shadow mask and a dot screen, said mask being rectangular and having two horizontal long sides and two vertical short sides, said long sides paralleling a central major axis of said mask and said short sides paralleling a central minor axis of said mask, said mask including an array of apertures arranged in vertical columns and horizontal rows, apertures in one row being in different columns than are the apertures in adjacent rows, the vertical spacing between adjacent apertures within a column being the vertical pitch of the apertures and the horizontal spacing between adjacent apertures within a row being the horizontal pitch of the apertures; the improvement comprising said horizontal pitch increasing from said minor axis to the short sides of said mask and decreasing from said major axis to the long sides of said mask, and said vertical pitch decreasing from the center of said mask to the short sides of said mask, along said major axis, and increasing from said minor axis to the corners of said mask, adjacent the long sides of said mask.

2. The tube as defined in claim 1, wherein said screen includes vertical columns and horizontal rows of phosphor dots, the vertical dot pitch on said screen being the vertical distance between two adjacent dots within the same column, comprising the vertical dot pitch being essentially the same over the entire screen.

3. The tube as defined in claim 1, wherein said screen has sides that bow outwardly, comprising said vertical pitch increasing from said major axis to the long sides of said mask.

* * * * *